US007155155B2

(12) United States Patent
Uehara et al.

(10) Patent No.: US 7,155,155 B2
(45) Date of Patent: Dec. 26, 2006

(54) FIXING DEVICE AND IMAGE FORMING APPARATUS

(75) Inventors: Yasuhiro Uehara, Kanagawa (JP); Motofumi Baba, Kanagawa (JP); Jyunpei Amano, Kanagawa (JP); Tohru Inoue, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 133 days.

(21) Appl. No.: 10/932,255

(22) Filed: Sep. 2, 2004

(65) Prior Publication Data

US 2005/0220507 A1 Oct. 6, 2005

(30) Foreign Application Priority Data

Mar. 30, 2004 (JP) ..... P2004-098697

(51) Int. Cl.
*G03G 15/20* (2006.01)

(52) U.S. Cl. ..... 399/329; 399/323; 399/406

(58) Field of Classification Search ..... 399/329, 399/323, 406, 328
See application file for complete search history.

(56) References Cited

U.S. PATENT DOCUMENTS 5,614,999 A * 3/1997 Kanesawa et al. ..... 399/329
2003/0063930 A1* 4/2003 Kiuchi et al. ..... 399/307
2004/0067081 A1* 4/2004 Kasahara ..... 399/329

FOREIGN PATENT DOCUMENTS

JP 3084692 B2 7/2000
JP 3298354 B2 4/2002

* cited by examiner

*Primary Examiner*—David M. Gray
*Assistant Examiner*—Erika J. Villaluna
(74) *Attorney, Agent, or Firm*—Morgan, Lewis & Bockius LLP

(57) ABSTRACT

To provide a fixing device which can suppress the occurrence of a temperature droop phenomenon, and to stably peel off a recording sheet from a fixing roll side. There are provided a fixing belt module and a pressure belt module, and the fixing belt module and the pressure belt module are in contact with each other through a fixing belt and a pressure belt in a first nip portion formed on a fixing roll around which the fixing belt is wound and a second nip portion formed on a pressure roll around which the pressure belt is wound.

20 Claims, 6 Drawing Sheets

FIG. 4

| RUBBER THICKNESS OF PRESSURE ROLL (mm) | 60gsm PAPER | 81gsm PAPER | 104gsm PAPER | 127gsm PAPER |
|---|---|---|---|---|
| 0 | × | × | × | ○ |
| 0.2 | × | × | ○ | ○ |
| 0.4 | × | ○ | ○ | ○ |
| 0.6 | × | ○ | ○ | ○ |
| 0.8 | ○ | ○ | ○ | ○ |
| 1.0 | ○ | ○ | ○ | ○ |

○ : EXCELLENT PEELING

× : THERE IS A CASE WHERE POOR PEELING OCCURS

FIXING DEVICE AND IMAGE FORMING APPARATUS

BACKGROUND OF THE INVENTION

1. Field of the Invention

The present invention relates to a fixing device, and more particularly to a fixing device for use in, for example, an image forming apparatus using an electrophotographic system.

2. Description of the Related Art

In an image forming apparatus, such as a copying machine or a printer, using an electrophotographic system, a photoreceptor (photosensitive drum) formed into, for example, a drum shape is uniformly charged, and the photosensitive drum is exposed with light controlled on the basis of image information to form an electrostatic latent image on the photosensitive drum. This electrostatic latent image is changed to a visible image (toner image) by toner, this toner image is transferred onto a recording sheet, and this is fixed by a fixing device to form an image.

A fixing device used for such an image forming apparatus includes, as shown in FIG. 6, a fixing roll 110 which has a cylindrical core metal 111 provided with a heat source 114 inside and is formed by laminating a heat resistant elastic layer 112 on the core metal 111 and by laminating a release layer 113 on the outer peripheral surface thereof, and a pressure roll 120 which is disposed to come in press contact with the fixing roll 110 and is formed by laminating a heat resistant elastic layer 122 on a core metal 121 and by laminating a release layer 123 of a heat resistant resin coating or a heat resistant rubber coating on the outer peripheral surface thereof. A recording sheet bearing a non-fixed toner image thereon is made to pass through between the fixing roll 110 and the pressure roll 120, and the non-fixed toner image is heated and pressed, so that a toner image is fixed on the recording sheet. The fixing device as stated above is called a roll nip system and is generally widely used.

In a case where an attempt is made to speed up the roll nip system fixing device, in order to supply a sufficient amount of heat to a toner and a recording sheet, it becomes necessary to widen a nip width in proportion to a fixing speed. As a method of widening the nip width, there is a method of increasing a load between a fixing roll and a pressure roll, a method of thickening the thickness of an elastic body, or a method of increasing a roll diameter.

However, in the method of increasing the load and the method of thickening the thickness of the elastic body, since the shape of the nip width becomes irregular along the roll axis because of the deflection of the roll, there arises such a problem in image quality that uneven fixation or a paper wrinkle occurs. In the method of increasing the roll diameter, there is a problem that the device becomes large, and a time (warm-up time) taken to heat the roll from room temperature to fixable temperature becomes long.

In order to solve these problems and to realize a fixing device capable of speeding up an image forming apparatus, the present applicant has proposed a technique relating to a fixing device which includes a fixing roll having a surface coated with an elastic body and an endless belt stretched by plural support rolls, and in which the endless belt is wound around the fixing roll over a specified angle area to form a nip area between the endless belt and the fixing roll, and a pressure is locally applied to an outlet of the nip area, the pressure being higher than that of the other portion of the nip area, to produce deformation in the elastic body of the fixing roll (refer to Japanese Patent No. 3,084,692, pages 5 to 8).

Further, the present applicant has proposed a technique relating to a fixing device which includes a rotatable fixing roll having an elastically deformed surface, an endless belt capable of running while being in contact with the fixing roll, and a pressure pad disposed in a non-rotation state at the inside of the endless belt, and in which the endless belt is brought into press contact with the fixing roll by the pressure pad so that a contact surface with the fixing roll is formed, a belt nip for allowing a sheet to pass through is provided between the endless belt and the fixing roll, and a portion of the surface of the fixing roll at the outlet side of the sheet is locally elastically deformed (Japanese Patent No. 3,298,354, pages 4 to 7).

In the technique disclosed in Japanese Patent No. 3,084,692, the belt nip is formed by the contact of the endless belt stretched by the plural rolls. In the technique disclosed in Japanese Patent No. 3,298,354, the endless belt is brought into press contact with the fixing roll by using the pressure pad so that the belt nip is formed. By adopting the structure as stated above, the width of the belt nip formed by the fixing roll and the endless belt can be easily made larger than the width of the roll nip between the conventional fixing roll and the pressure roll. Thus, it becomes possible to deal with speeding-up, and it is also easy to miniaturize the device.

Especially, since the heat capacity of the endless belt brought into press contact with the fixing roll is small, heat transmitted from the fixing roll is hard to dissipate. Thus, even if the rotation of the fixing roll is started, the amount of heat removed from the fixing roll to the endless belt side is relatively small, and the efficiency of using heat for the melting of toner becomes high, and therefore, there is also a merit that the fixation of the toner can be improved.

SUMMARY OF THE INVENTION

However, in fixing devices disclosed in Japanese Patent No. 3,084,692 and Japanese Patent No. 3,298,354 (these are known generally as "belt nip system"), when a speed of an image forming apparatus is enhanced, and a fixing processing is performed to many recording sheets continuously sent in a short time, a surface temperature of a fixing roll is temporarily lowered at start-up of the image forming apparatus, that is, a so-called "temperature droop" phenomenon occurs. Since an elastic layer coated on a core metal of the fixing roll and made of silicone rubber or the like acts as a heat resistor, even if a sufficient amount of heat is supplied from an inside of the fixing roll, a time lag occurs before a heat is transmitted to the surface of the fixing roll, so that this temperature droop phenomenon is caused. Especially, in cardboard or the like having a large heat capacity, since an amount of heat removed from the surface of the fixing roll becomes large, there is an tendency that the temperature droop becomes large. Thus, in a case where an attempt is made to further speed up the image forming apparatus, there arises a new problem that poor fixation is apt to occur for a certain number of recording sheets before the surface temperature of the fixing roll is restored.

Further, since a recording sheet bears a toner image on its surface, the toner image is melted by heat of the fixing roll side, and the recording sheet and the surface of the fixing roll side are placed in such a state that they are apt to adhere to each other. Thus, also in a belt nip system fixing device, a release layer is formed on the surface of the fixing roll side, and the adhering force of the recording sheet and the surface of the fixing roll side is reduced, and further, a portion of the elastic body of the surface of the fixing roll at the outlet side of the nip portion is locally elastically deformed to create a down curl in the recording sheet, and peeling from the fixing roll side is accelerated. However, in the case where an attempt is made to speed up the image forming apparatus, when poor peeling once occurs and a jam occurs, the number of subsequent recording sheets damaged by the influence becomes large. Thus, it is also necessary to stably peel off the recording sheet having passed through the nip portion at high speed from the fixing roll side.

The present invention has been made to solve the technical problem as stated above, and an object thereof is to provide a fixing device which can deal with the speeding up of an image forming apparatus and can suppress the occurrence of a temperature droop phenomenon.

Another object is to stably peel off a recording sheet from a fixing roll side.

Under the objects as stated above, according to one aspect of the invention, there is provided a fixing device including: a first belt module that includes a fixing belt wound around a first stretching roll and a fixing roll; and a second belt module that includes a pressure belt wound around a second stretching roll and a pressure roll disposed to press the fixing roll, wherein the fixing belt of the first belt module and the pressure belt of the second belt module come in contact with each other in a first nip portion and a second nip portion.

Preferably, the first nip portion and the second nip portion are continuous with each other. The second belt module can include a press member that presses the pressure belt to a side of the fixing roll in the first nip portion. Further, the first belt module can include a press member that presses the fixing belt to a side of the pressure roll in the second nip portion.

Preferably, a convex direction of the first nip portion and a convex direction of the second nip portion are opposite to each other. Besides, the first belt module can include a peeling roll that presses the fixing belt to a side of the pressure roll. Preferably, the peeling roll can form a recess on a surface of the pressure roll.

According to another aspect of the invention, there is provided a fixing device for fixing a toner image born on a recording member, including: a rotatable fixing roll; a fixing belt stretched over the fixing roll; a stretching roll that stretches the fixing belt; a pressure roll disposed to be pressed to the fixing roll; a pressure belt stretched over the pressure roll and forming a nip portion with the fixing belt; and a peeling roll disposed to bring an outer surface of the fixing belt into contact with the pressure roll.

Preferably, the peeling roll is disposed to come in contact with the pressure roll through the fixing belt and the pressure belt. Preferably, the peeling roll is disposed at a most downstream portion of the nip portion.

The pressure roll can have an elastic layer thereon. Further, the pressure belt can include an elastic layer. Preferably, the fixing roll, the pressure roll and the peeling roll satisfy the following formula in outer diameters: the fixing roll>the pressure roll>the peeling roll. Preferably, the fixing roll, the pressure roll and the peeling roll satisfy the following formula in surface hardness: the peeling roll>the pressure roll>the fixing roll.

Further, the fixing roll can include a heating member inside, and the stretching roll can include a heating member inside. Besides, the stretching roll can include a plurality of the stretching rolls, preferably at least one of the stretching rolls is disposed to come in contact with an outer surface of the fixing belt.

According to still another aspect of the invention, there is provided an image forming apparatus including: a toner image formation unit that forms a toner image; a transfer unit that transfers the toner image formed by the toner image formation unit onto a recording member; and a fixing unit that fixes the toner image transferred onto the recording member to the recording member, wherein the fixing unit includes: a rotatable fixing roll; a fixing belt stretched over the fixing roll; a stretching roll that stretches the fixing belt; a pressure roll disposed to be pressed to the fixing roll; and a pressure belt stretched over the pressure roll, wherein a first nip portion is formed on the fixing roll around which the fixing belt is wound, and a second nip portion is continuous with the first nip portion and formed on the pressure roll around which the pressure belt is wound.

Preferably, the fixing unit fixes the toner image onto the recording member in the first nip portion, and reduces an adhesion force between the recording member and the fixing belt in the second nip portion. Besides, the fixing unit can include a heating member inside, and the stretching roll can include a heating member inside.

As an effect of the invention, it becomes possible to deal with the speeding up of the image forming apparatus and to suppress the occurrence of the temperature droop phenomenon in the fixing device. At the same time, it also becomes possible to stably peel off the recording sheet from the fixing roll side.

BRIEF DESCRIPTION OF THE DRAWING

These and other objects and advantages of this invention will become more fully apparent from the following detailed description taken with the accompanying drawings in which:

FIG. 4 is a view showing results of comparison of self stripping performances in the case where pressure rolls having elastic layers with different thickness are used;

DETAILED DESCRIPTION OF THE PREFERRED EMBODIMENTS

Hereinafter, embodiments of the invention will be described in detail with reference to the accompanying drawings.

[Embodiment 1]

Figure 1:
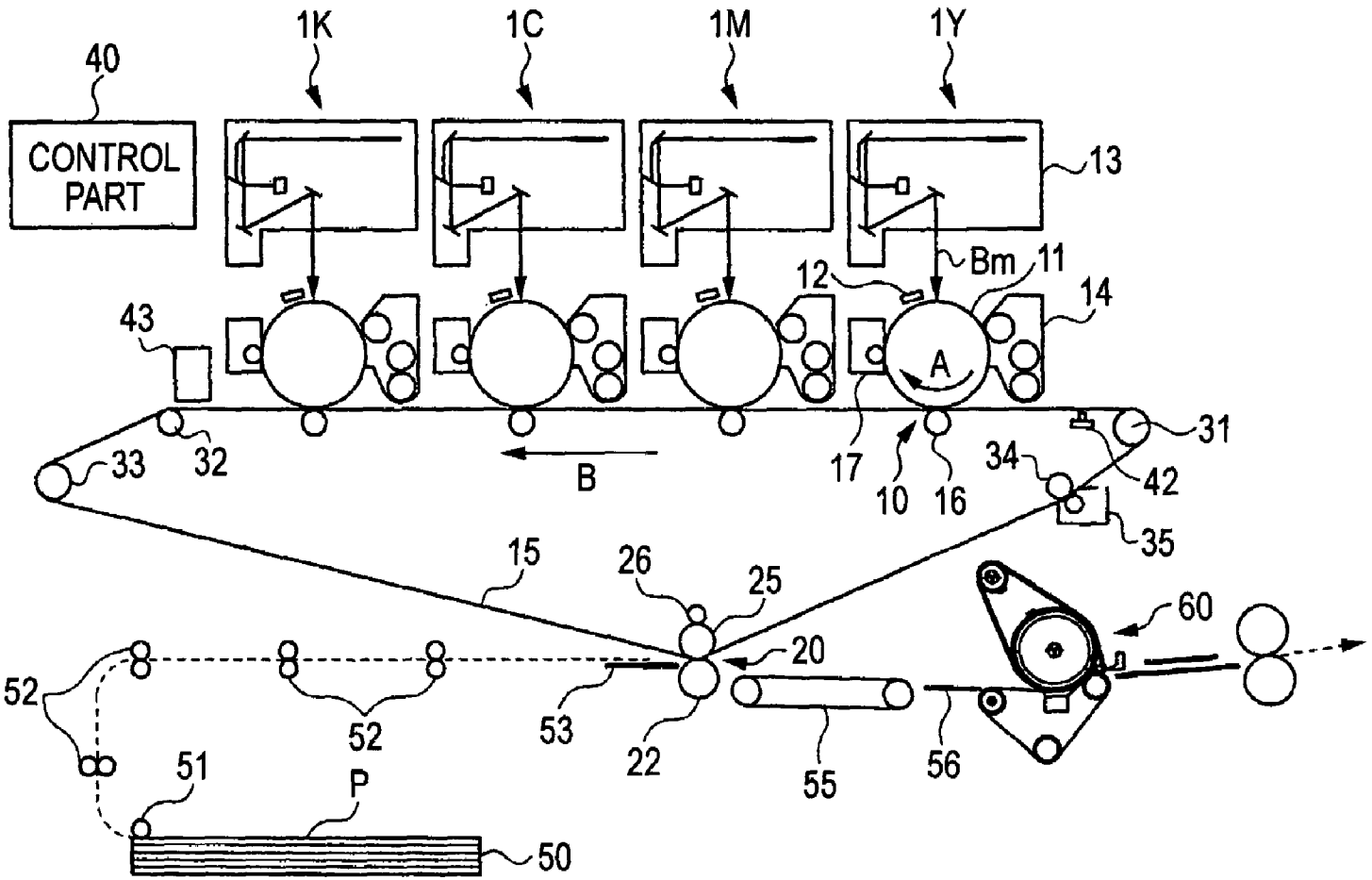
FIG. 1 is a schematic structural view showing an image forming apparatus of the invention.

FIG. 1 is a schematic structural view showing an image forming apparatus to which this embodiment is applied. The image forming apparatus shown in FIG. 1 is an image forming apparatus of an intermediate transfer system generally called a tandem type, and includes plural image formation units 1Y, 1M, 1C and 1K in which toner images of respective color components are formed by an electrophotographic system, a primary transfer part 10 for sequentially transferring (primary transfer) the toner images of the respective color components formed by the image formation units 1Y, 1M, 1C and 1K onto an intermediate transfer belt 15, a secondary transfer part 20 for transferring (secondary transfer) the superimposed toner images transferred on the intermediate transfer belt 15 onto a sheet P as a recording member (recording sheet) at once, and a fixing device 60 for fixing the secondarily transferred image to the sheet P. Besides, a control part 40 for controlling the operation of the respective devices (parts) is included.

In this embodiment, in each of the image formation units 1Y, 1M, 1C and 1K, there are sequentially provided, around a photoreceptor drum 11 rotating in a direction of an arrow A, devices for electrophotography, such as a charger 12 for charging the photoreceptor drum 11, a laser exposure unit 13 for writing an electrostatic latent image on the photosensitive drum 11 (in the drawing, an exposure beam is denoted by reference character Bm), a developer 14 in which toner of each color component is contained and which changes the electrostatic latent image on the photosensitive drum 11 into a visible image by the toner, a primary transfer roll 16 for transferring the toner image of each color component formed on the photosensitive drum 11 onto the intermediate transfer belt 15 in the primary transfer part 10, and a drum cleaner 17 for removing residual toner on the photosensitive drum 11. These image formation units 1Y, 1M, 1C and 1K are arranged substantially linearly in the order of yellow (Y), magenta (M), cyan (C) and black (K) from the upstream side of the intermediate transfer belt 15.

The intermediate transfer belt 15 as the intermediate transfer body is constructed of a film-like endless belt in which a suitable amount of antistatic agent such as carbon black is contained in resin such as polyimide or polyamide. Its volume resistivity is configured to be $10^6$ to $10^{14}$ Ωcm, and its thickness is configured to be, for example, about 0.1 mm. The intermediate transfer belt 15 is circulation driven (rotated) at a specified speed in the direction of an arrow B shown in FIG. 1 by various rolls. The various rolls include a drive roll 31 driven by a motor (not shown) superior in constant speed and for rotating the intermediate transfer belt 15, a support roll 32 for supporting the intermediate transfer belt 15 extending substantially linearly along the arrangement direction of the respective photosensitive drums 11, a tension roll 33 functioning as a correction roll to give a specific tensile force to the intermediate transfer belt 15 and to prevent meandering of the intermediate transfer belt 15, a backup roll 25 provided in the secondary transfer part 20, and a cleaning backup roll 34 provided in the cleaning part and for removing residual toner on the intermediate transfer belt 15.

The primary transfer part 10 is constructed of the primary transfer roll 16 disposed to be opposite to the photosensitive drum 11 through the intermediate transfer belt 15. The primary transfer roll 16 is constructed of a shaft and a sponge layer as an elastic layer fixed to the surrounding of the shaft. The shaft is a cylindrical rod formed of metal such as iron or SUS. The sponge layer is formed of blend rubber of NBR, SBR and EPDM in which a conductive agent such as carbon black is mixed, and is a sponge-like cylindrical roll having a volume resistivity of $10^7$ to $10^9$ Ωcm. The primary transfer roll 16 is disposed to be pressed to the photosensitive drum 11 through the intermediate transfer belt 15, and a voltage (primary transfer bias) with a polarity opposite to a charging polarity of the toner (which is assumed to be a minus polarity. The same shall apply hereinafter) is applied to the primary transfer roll 16. By this, the toner images on the respective photosensitive drums 11 are sequentially electrostatically attracted by the intermediate transfer belt 15, and the superimposed toner images are formed on the intermediate transfer belt 15.

The secondary transfer part 20 is constructed of a secondary transfer roll 22 disposed at a toner image bearing surface side of the intermediate transfer belt 15 and the backup roll 25. The surface of the backup roll 25 is formed of a tube of blend rubber of EPDM and NBR in which carbon is dispersed, and the inside thereof is formed of EPDM rubber. Its surface resistivity becomes $10^7$ to $10^{10}$ Ω/□, and its hardness is set to, for example, 70° (Askar C). This backup roll 25 is disposed at the back surface side of the intermediate transfer belt 15 to form an opposite electrode of the secondary transfer roll 22, and a metal feed roll 26 to which a secondary transfer bias is stably applied is disposed to be in contact therewith.

On the other hand, the secondary transfer roll 22 is constructed of a shaft and a sponge layer as an elastic layer fixed to the surrounding of the shaft. The shaft is a cylindrical rod made of metal such as iron or SUS. The sponge layer is formed of blend rubber of NBR, SBR and EPDM in which a conductive agent such as carbon black is mixed, and is a sponge-like cylindrical roll having a volume resistivity of $10^7$ to $10^9$ Ωcm. The secondary transfer roll 22 is disposed to be pressed to the backup roll 25 through the intermediate transfer belt 15, and further, the secondary transfer roll 22 is grounded and the secondary transfer bias is formed with the backup roll 25, so that the toner image is secondarily transferred onto the sheet P transported to the secondary transfer part 20.

An intermediate transfer belt cleaner 35 for removing the residual toner and paper powder on the intermediate transfer belt 15 after the secondary transfer and for cleaning the surface of the intermediate transfer belt 15 is provided at the downstream side of the secondary transfer part 20 of the intermediate transfer belt 15 so as to be capable of coming in contact with/separating from the intermediate transfer belt. On the other hand, a reference sensor (home position sensor) 42 for generating a reference signal as reference for image formation timing in the respective image formation units 1Y, 1M, 1C and 1K is disposed at the upstream side of the yellow image formation unit 1Y. An image concentration sensor 43 for performing picture quality adjustment is disposed at the downstream side of the black image formation unit 1K. This reference sensor 42 recognizes a specified mark provided at the backside of the intermediate transfer belt 15 and generates the reference signal. The respective image formation units 1Y, 1M, 1C and 1K start the image formation according to instructions from the control part 40 on the basis of the recognition of this reference signal.

Further, in the image forming apparatus of this embodiment, a sheet transfer system includes a sheet tray 50 for containing the sheet P, a pickup roll 51 for taking out the sheet P stacked on the sheet tray 50 at a predetermined timing and transporting it, a transport roll 52 for transporting the sheet P sent out by the pickup roll 51, a transport chute 53 for sending the sheet P transported by the transport roll 52 to the secondary transfer part 20, a transport belt 55 for transporting the sheet P, which is to be transported after the secondary transfer is performed by the secondary transfer roll 22, to the fixing device 60, and a fixing inlet guide 56 for guiding the sheet P to the fixing device 60.

Next, a basic imaging process of the image forming apparatus of this embodiment will be described. In the image forming apparatus as shown in FIG. 1, image data outputted from a not-shown image reader (IIT) or a not-shown personal computer (PC) is subjected to a specified image processing by a not-shown image processing apparatus (IPS), and then, an imaging operation is performed by the image formation units 1Y, 1M, 1C and 1K. In the IPS, a specified image processing such as shading correction, position shift correction, brightness/color space conversion, gamma correction, frame deletion and various image editing operations such as color editing and movement editing is performed for inputted reflectivity data. The image data subjected to the image processing is converted into color material gradation data of four colors of Y, M, C and K, and is outputted to the laser exposure unit 13.

In the laser exposure unit 13, according to the inputted color material gradation data, the exposure beam Bm emitted from, for example, a semiconductor laser is irradiated on the photosensitive drum 11 of each of the image formation units 11Y, 1M, 1C and 1K. In each of the photosensitive drums 11 of the image formation units 1Y, 1M, 1C and 1K, after its surface is charged by the charger 12, the surface is scan-exposed by the laser exposure unit 13, and an electrostatic latent image is formed. The formed electrostatic latent images are developed as toner images of the respective colors of Y, M, C, and K by the respective image formation units 1Y, 1M, 1C and 1K.

The toner images formed on the photosensitive drums 11 of the image formation units 1Y, 1M, 1C and 1K are transferred onto the intermediate transfer belt 15 at the primary transfer parts 10 where the respective photosensitive drums 11 come in contact with the intermediate transfer belt 15. More specifically, at each of the primary transfer parts 10, a voltage (primary transfer bias) with a polarity opposite to a charging polarity (minus polarity) of the toner is applied to the base material of the intermediate transfer belt 15 by the primary transfer roll 16, the toner images are sequentially superimposed onto the surface of the intermediate transfer belt 15 and the primary transfer is performed.

After the toner images are sequentially primarily transferred onto the surface of the intermediate transfer belt 15, the intermediate transfer belt 15 is moved and the toner images are transported to the secondary transfer part 20. When the toner images are transported to the secondary transfer part 20, in the sheet transport system, the pickup roll 51 is rotated according to the timing when the toner images are transported to the secondary transfer part 20, and the sheet P with a specified size is supplied from the sheet tray 50. The sheet P supplied by the pickup roll 51 is transported by the transport roll 52, and reaches the secondary transfer part 20 through the transport chute 53. Before reaching the secondary transfer part 20, the sheet P is temporarily stopped, and a registration roll (not shown) is rotated according to the movement timing of the intermediate transfer belt 15 on which the toner images are born, so that the positioning of the position of the sheet P and the position of the toner images is performed.

At the secondary transfer part 20, the secondary transfer roll 22 is pressed to the backup roll 25 through the intermediate transfer belt 15. At this time, the sheet P transported according to the timing is nipped between the intermediate transfer belt 15 and the secondary transfer roll 22. At that time, when the voltage (secondary transfer bias) with the same polarity as the charging polarity (minus polarity) of the toner is applied from the feed roll 26, a transfer electric field is formed between the secondary transfer roll 22 and the backup roll 25. The non-fixed toner images born on the intermediate transfer belt 15 are electrostatically transferred onto the sheet P at once in the secondary transfer part 20 where they are pressed by the secondary transfer roll 22 and the backup roll 25.

Thereafter, the sheet P on which the toner images are electrostatically transferred is transported by the secondary transfer roll 22 in a state where it is peeled off from the intermediate transfer belt 15, and is transported to the transport belt 55 provided at the downstream side of the secondary transfer roll 22 in the sheet transport direction. The transport belt 55 transports the sheet P to the fixing device 60 in accordance with an optimum transport speed in the fixing device 60. The non-fixed toner images on the sheet P transported to the fixing device 60 are subjected to a fixing processing with heat and pressure by the fixing device 60, and are fixed on the sheet P. The sheet P on which the fixed image is formed is transported to a paper output mount part provided at an ejection part of the image forming apparatus.

On the other hand, after the transfer onto the sheet P is ended, the residual toner remaining on the intermediate transfer belt 15 is transported to the cleaning part in accordance with the rotation of the intermediate transfer belt 15, and is removed from the intermediate transfer belt 15 by the cleaning backup roll 34 and the intermediate transfer belt cleaner 35.

Next, the fixing device 60 used for the image forming apparatus of this embodiment will be described.

Figure 2:
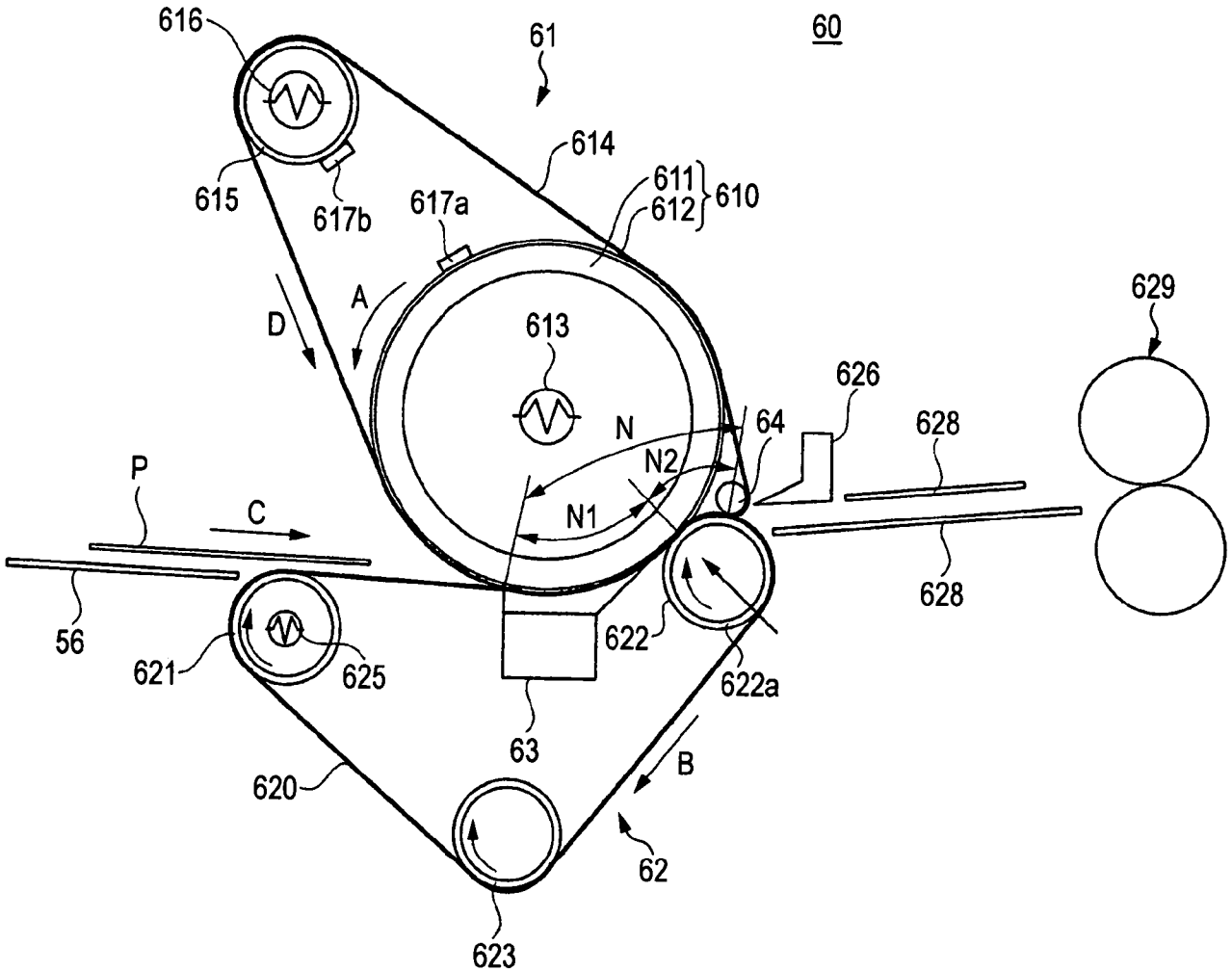
FIG. 2 is a side sectional view showing a structure of a fixing device of embodiment 1.

FIG. 2 is a side sectional view showing the structure of the fixing device 60 of this embodiment. The main part of this fixing device 60 is constructed of a fixing belt module (first belt module) 61 and a pressure belt module (second belt module) 62.

The fixing belt module 61 is constructed of a fixing roll 610 rotating in the direction of an arrow A, a stretching roll 615 inside which a halogen heater 616 as a heating member is disposed, a peeling roll 64 disposed at the most downstream portion of a nip portion. N, and a fixing belt 614 stretched over the fixing roll 610, the stretching roll 615 and the peeling roll 64 and driven and rotated in the direction of an arrow D.

The fixing roll 610 is a soft roll having an outer diameter of 65 mmϕ and a length of 350 mm, in which a surface of a core metal 611 formed of aluminum and having a thickness of 5 mm is coated with an elastic layer 612 having a thickness of 1.5 mm. LSR (Liquid Silicone Rubber) having a rubber hardness of 25 to 45 Hs (JIS-A) is used for the elastic layer 612. The fixing roll 610 is rotated in the direction of the arrow A at a surface speed of 400 mm/s.

A halogen heater 613 having a rated power of 1000W as a heating member is disposed in the inside of the fixing roll 610. On the basis of a measurement value of a temperature sensor 617*a* disposed to come in contact with the surface of the fixing roll 610, the control part 40 (see FIG. 1) of the image forming apparatus controls the surface temperature of the fixing roll 610 to be 160° C.

The material of the elastic layer 612 is not limited to silicone rubber, and various conventionally well-known materials such as, for example, fluorine rubber can be used. Besides, the elastic layer 612 in which plural layers made of silicon rubber and fluorine rubber are laminated may be used. Further, as the fixing roll 610, a so-called hard roll having no elastic layer 612 can be used. In this case, heat supply from the fixing roll 610 to the fixing belt 614 is made further efficient, and the fixing device 60 with lower temperature droop and superior in high speed suitability can be obtained.

The fixing belt 614 is stretched by a tensile force of 10 kgf by the fixing roll 610, the stretching roll 615, and the peeling roll 64 disposed at the most downstream portion of the nip portion N. The fixing belt 614 is formed of a flexible endless belt having a peripheral length of 330 mm and a width of 340 mm.

The fixing belt 614 has a multi-layer structure constructed of a base layer made of polyimide resin and having a thickness of 75 μm, an elastic layer laminated on the surface side (outer peripheral surface side) of the base layer, made of silicone rubber and having a thickness of 200 μm, and a surface layer on the elastic layer, as a release layer, made of tetrafluoroethylene-perfluoroalkyl vinyl ether copolymer resin (PFA) and having a thickness of 30 μm. Here, the elastic layer is provided especially to improve the picture quality of a color image, and in this embodiment, silicone rubber with a rubber hardness of 20 Hs (JIS-A) is used. Incidentally, with respect to the structure of the fixing belt 614, the material, thickness, hardness and the like can be suitably selected according to apparatus design conditions such as a use object and a user condition.

The stretching roll 615 is formed of a stainless pipe roll having an outer diameter of 23 mmϕ, a thickness of 2 mm, and a length of 350 mm. A halogen heater 616 with a rated power of 800 W, as a heating member, is disposed inside the stretching roll 615, and the surface temperature of the stretching roll 615 is controlled to be 200° C. by a temperature sensor 617*b* and the control part 40 (see FIG. 1). Accordingly, the stretching roll 615 has not only a function to stretch the fixing belt 614 but also a function to heat the fixing belt 614.

In order to make a variation of the fixing belt 614 in an axial direction as small as possible, and in order to uniform the stretching of the fixing belt 614, the stretching roll 615 is formed into a so-called crown shape in which an outer diameter at the center part is larger than that at an end part by 100 μm.

The peeling roll 64 is a small diameter stainless roll formed to have an outer diameter of 8 mmϕ and a length of 350 mm. The peeling roll 64 is disposed at the downstream side of and in the vicinity of a contact part between the fixing roll 610 and a pressure roll 622 disposed in the pressure belt module 62 described later and to be brought into press contact with the pressure roll 622 at a load 5 of kgf. At that time, in order to uniform the press force in the axial direction, the peeling roll is formed into the so-called crown shape in which an outer diameter at the center part is larger than that at an end part by 400 μm.

Besides, for example, a rubber layer having a thickness of 50 to 200 μm and high friction coefficient may be formed on the surface of the peeling roll 64 in order to make followability to the fixing belt 614 excellent.

A main part of the pressure belt module 62 is constructed of a pressure belt 620 stretched by three rolls, that is, a lead roll 621, the pressure roll 622 and a stretching roll 623, and a pressure pad (press member) 63 disposed at the inside of the pressure belt 620 and in a state where it is urged to the fixing roll 610 through the pressure belt 620. The pressure belt module 62 is disposed to be pressed to the fixing belt module 61, and as the fixing roll 610 of the fixing belt module 61 is rotated in the direction of the arrow A, the pressure belt 620 is rotated in the direction of an arrow B in accordance with the fixing roll 610. Its moving speed is 400 mm/s equal to the surface speed of the fixing roll 610.

In the contact portion (nip portion N) between the pressure belt module 62 and the fixing belt module 61, and in an area where the fixing belt 614 is wound (wrapped) around the fixing roll 610 (hereinafter, such an area is referred to as a "wrap area"), a first nip portion N1 is formed in which the pressure belt 620 comes in press contact with the outer peripheral surface of the fixing belt 614. In this first nip portion N1, the pressure pad 63 is disposed inside the pressure belt 620 and in the state where it is urged to the fixing roll 610 side through the pressure belt 620, and the pressure pad presses the pressure belt 620 to the wrap area of the fixing roll 610. Besides, at the most downstream portion of the first nip portion N1, the pressure roll 622 is urged by a compression coil spring (not shown) as a pressure unit to the center axis of the fixing roll 610 through the pressure belt 620 and the fixing belt 614, and a local high pressure is produced at the contact part of the fixing roll 610 and the fixing belt 614.

Further, at the downstream side of the first nip portion N1, in a wrap area where the pressure belt 620 is wound around the pressure roll 622, and in a range from an area where the pressure roll 622 is in press contact with the fixing roll 610 to an area where the peeling roll 64 is in press contact with the pressure roll 622, a second nip portion N2 in which the fixing belt 614 is formed to come in press contact with the wrap area of the pressure roll 622 is formed to be continuous with the first nip portion N1.

When passing through the nip portion (the first nip portion N1 and the second nip portion N2), the sheet P bearing the toner images thereon is heated and pressed mainly in the first nip portion N1, and the toner images are fixed on the sheet P. The second nip portion N2 exerts an action with respect to the sheet P to peel off the sheet P from the fixing belt 614 at the outlet of the second nip portion N2. That is, in the second nip portion N2, a preparation step for certainly peeling off the sheet P from the fixing belt 614 is performed.

Incidentally, in the fixing device 60 of this embodiment, the first nip portion N1 is formed as a band-like area extended by 45° in a center angle with respect to the rotation axis of the fixing roll 610 (hereinafter, this center angle is referred to as a "wrap angle"), and the nip width in this case is 26 mm. The second nip portion N2 is formed as a band-like area extended by 45° in the wrap angle with respect to the pressure roll 622, and the nip width in this case is 9.8 mm.

Here, it is preferable that the pressure belt 620 is constructed of a base layer, a release layer coated on a surface at the fixing roll 610 side or both surfaces, and an elastic layer formed between the base layer and the release layer. The base layer is formed of resin having high heat resistance, and for example, polyimide, polyamide, or polyamide-imide is suitable. The thickness of the base layer is, for example, about 50 to 125 μm, more preferably 75 to 100 μm.

Besides, it is preferable that the release layer is a coating made of fluorine resin, for example, PFA and having a thickness of 5 to 20 μm. As the elastic layer, silicone rubber with a thickness of 20 to 500 μm, preferably 50 to 300 μm and rubber hardness of 8 to 70 Hs (JIS-A), preferably, 15 to 30 Hs (JIS-A) can be used.

In the fixing device 60 of this embodiment, the pressure belt 620 is constructed of abase layer of a polyimide film having a thickness of 75 μm, a width of 340 mm and a peripheral length of 288 mm, and an elastic layer made of silicone rubber and having a rubber hardness of 30 Hs (JIS-A) and a thickness of 100 μm, and a release layer made of fluorine resin (PFA) and having a thickness of 30 μm, which are laminated on an outer surface side (fixing belt module 61 side).

The three rolls for stretching the pressure belt 620 include the lead roll 621 made of stainless, the pressure roll 622 in which silicone rubber having a rubber hardness of 30 Hs (JIS-A) and a thickness of 1.0 mm is coated as an elastic layer 622*a* on the outer surface of a stainless roll, and the stretching roll 623 made of stainless, and stretch the pressure belt 620 by a tensile force of 10 kgf. The outer diameters of the respective rolls are 22 mmϕ, 25 mmϕ and 20 mmϕ, and the length is 340 mm. A halogen heater 625 as a heating source is disposed inside the lead roll 621. Its surface temperature is controlled to be 120° C. by a not-shown temperature sensor and the control part 40 (see FIG. 1), and preheating is given to the pressure belt 620.

Incidentally, it is also possible to adopt such a structure that a belt edge position detection mechanism of the pressure belt 620 and an axial displacement mechanism for displacing the contact position of the pressure belt 620 in the axial direction according to the detection result of the belt edge position detection mechanism are disposed at one of the lead roll 621, the pressure roll 622 and the stretching roll 623, and control the meandering (belt walk) of the pressure belt 620.

The pressure pad 63 as a press member is constructed of an elastic member for ensuring the wide first nip portion N1 and a low friction layer provided on a surface of the elastic member which comes in contact with the inner peripheral surface of the pressure belt 620, and is held in a holder (not shown) made of metal or the like. The elastic member having the low friction layer on the surface is formed, at the fixing roll 610 side, into a recess shape substantially along the outer peripheral surface of the fixing roll 610, is disposed to be pressed to the fixing roll 610, and forms the inlet side area of the first nip portion N1 formed in the wrap area of the fixing roll 610.

As the elastic member of the pressure pad 63, an elastic body having high heat resistance, such as silicone rubber or fluorine rubber, or a plate spring can be used. The low friction layer formed on the elastic member is provided to lessen the slide resistance between the inner peripheral surface of the pressure belt 620 and the pressure pad 63, and it is desirable that the material has low friction coefficient and sufficient wear resistance. Specifically, a glass fiber sheet impregnated with Teflon (registered trademark), a fluorine resin sheet, a fluorine resin coating or the like can be used.

As the pressure pad 63, in addition to one molded into a pad shape as in this embodiment, for example, one molded into a roll shape can also be used. Such a roll-shaped pad may be urged to the surface of the fixing roll 610 through the pressure belt 620 and may be driven and rotated. However, as in this embodiment, the pressure pad 63 molded into the pad shape can give the nip pressure more widely and uniformly over the whole contact area of the first nip portion N1.

The pressure roll 622 disposed at the downstream side of the pressure pad 63 in a sheet P transport direction (direction of an arrow C) is urged to the center axis of the fixing roll 610 through the pressure belt 620 and the fixing belt 614 by a compression coil spring (not shown) as a pressure unit, and generates a local high pressure at the contact part of the fixing roll 610 and the fixing belt 614. In order to effectively give the local high pressure to the fixing roll 610 and the fixing belt 614 by a low load, it is desirable that the pressure roll 622 is smaller than the fixing roll 610 in diameter, and its surface is formed to be harder than the surface of the fixing roll 610.

Next, a fixing operation in the fixing device 60 of this embodiment will be described.

The sheet P on which the non-fixed toner image is electrostatically transferred in the secondary transfer part 20 (see FIG. 1) of the image forming apparatus is transported toward (direction of an arrow C) the first nip portion N1 of the fixing device 60 by the transport belt 55 and the fixing inlet guide 56. The non-fixed toner image on the surface of the sheet P passing through the first nip portion N1 is fixed on the sheet P by pressure and heat acting in the first nip portion N1. In the fixing device 60 of this embodiment, as described above, the fixing roll 610 around which the fixing belt 614 is wrapped and the pressure belt 620 are brought into contact with each other, while the pressure pad 63 is pressed. Thus, since the first nip portion N1 can be set to be wide, and stable fixing performance can be secured.

At this time, the heat acting in the first nip portion N1 is mainly supplied by the fixing belt 614. The fixing belt 614 is constructed to be heated by heat supplied through the fixing roll 610 from the halogen heater 613 disposed inside the fixing roll 610 and heat supplied through the stretching roll 615 from the halogen heater 616 disposed inside the stretching roll 615. Thus, even in the case where heat energy of only the fixing roll 610 is insufficient, heat energy can be supplied from the stretching roll 615 suitably and quickly. Thus, in the nip portion N, even when the process speed is as high as 400 mm/s, a sufficient amount of heat can be ensured.

In the case where the process speed is as high as 400 mm/s as in the image forming apparatus of this embodiment, the sheet P is transported in sequence to the first nip portion N1 of the fixing device 60 and continuous fixing is performed. At that time, in the first nip portion N1, the heat is removed by the sheet P and the non-fixed toner image, and heat release from the pressure belt module 62 is also increased. Thus, when the pressure belt 620 is simply wound around the fixing roll 610, the amount of drop in surface temperature of the fixing roll 610 becomes very large. In addition, in this case, the heat energy is supplied only from the inside of the fixing roll 610 by the halogen heater 613, and since the fixing roll 610 itself has a thickness, a time lag exists before the heat from the halogen heater 613 reaches the surface.

In order to deal with this, when an attempt is made to keep the surface temperature of the fixing roll 610 at a necessary temperature by only the structure of the fixing roll 610, there arises necessity to supply a very large amount of heat from the inside of the fixing roll 610. In such a method, energy loss is large, and the load of the apparatus itself is also large. Further, since the surface temperature of the fixing roll 610 becomes unnecessarily high after the end of the continuous fixing, there is also a fear that the fixing roll 610 is damaged, and poor fixing occurs at a next image formation cycle.

As one of countermeasures against that, a method is conceivable in which an external heating device such as an external heating roll is disposed to come in direct contact with the surface of the fixing roll 610, and the surface of the fixing roll 610 is subsidiarily heated from outside. However, since it is difficult to set a contact width between the external heating roll and the surface of the fixing roll 610 to be large, it is eventually difficult to supply a sufficient amount of heat to the surface of the fixing roll 610.

Accordingly, in the case where the heating member is constructed of only the fixing roll 610 like the general fixing device of the roll nip system or the belt nip system, when the speed of the image forming apparatus is increased, it has been very difficult, because of the foregoing reason, to return the fixing roll 610 having a large heat capacity to a specified fixing temperature in one rotation in which the surface layer of the fixing roll 610 is returned again to the area where it comes in contact with the sheet P after the surface layer passes through the area (nip portion N) where it comes in contact with the sheet P. Thus, there arises such a state that the temperature of the fixing roll is not returned to the specified fixing temperature by only one rotation of the fixing roll 610, and especially at start-up of the image forming apparatus, there is a case where the temperature droop (phenomenon in which the surface temperature of the fixing roll is temporarily lowered) occurs and poor fixation occurs.

On the other hand, in the fixing device 60 of this embodiment, the stretching roll 615 inside which the halogen heater 616 is provided is disposed in parallel to the fixing roll 610, and the endless fixing belt 614 is stretched by the stretching roll 615 and the fixing roll 610. In the structure as stated above, the fixing belt 614 functions as the direct heating member for heating the sheet P, and both the fixing roll 610 and the stretching roll 615 function as the heat supply members for supplying heat to the fixing belt 614. However, since the fixing roll 610 is in contact with the sheet P through the fixing belt 614, the fixing roll has also the function to directly heat the sheet P.

In the structure as stated above, the fixing belt 614 functioning as the direct heating member can be formed to have a very small heat capacity. In addition, since the fixing belt can come in contact with both the fixing roll 610 and the stretching roll 615 as the heat supply members at the wide wrap areas (large wrap angles), a sufficient amount of heat is supplied from the fixing roll 610 and the stretching roll 615 in a short period when the fixing belt 614 makes one rotation, and therefore, it becomes possible to return the fixing belt 614 to a necessary fixing temperature.

As stated above, in the fixing device 60 of this embodiment, since the fixing belt 614 having the very small heat capacity can come in contact with both the fixing roll 610 and the stretching roll 615 as the heat supply members at the wide wrap areas (wide wrap angles), the conduction of heat from the fixing roll 610 and the stretching roll 615 to the fixing belt 614 is quickly and sufficiently performed, and it becomes possible to return the fixing belt 614 to the necessary fixing temperature in a short time when the fixing belt 614 makes one rotation. Accordingly, in the first nip portion N1, even if the speed of the fixing device 60 is increased, the specified fixing temperature can be always kept.

As a result, it becomes possible to suppress the occurrence of the temperature droop as a serious problem at the time of high speed fixation. Especially, even in the fixation to a thick sheet having a large heat capacity, the occurrence of the temperature droop can be suppressed. Besides, even in the case where it is necessary to change fixing temperature halfway according to the kind of paper (including both cases of raising and lowing the fixing temperature), since the fixing belt 614 has a small heat capacity, the change to a desired temperature can be easily performed by the output adjustment of the halogen heater 613 and the halogen heater 616, and can be quickly performed.

Besides, the fixing device 60 of this embodiment is constructed such that in the first nip portion N1, the pressure belt 620 of the pressure belt module 62 comes in contact with the outer peripheral surface of the fixing belt 614 only in the area (wrap area) in which the fixing belt 614 is wound around the surface of the fixing roll 610. That is, in the first nip portion N1, the fixing roll 610 is positioned over all the area at the inner peripheral surface side of the fixing belt 614. Accordingly, since there arises a state in which the contact between the fixing belt 614 and the pressure belt 620 is stably supported by the surface of the fixing roll 610, they can be brought into uniform close contact with each other over all the area of the first nip portion N1. Since the conduction of heat from the fixing belt 614 to the sheet P can be efficiently performed by the excellent adhesiveness between the fixing belt 614 and the pressure belt 620, it is possible to more effectively suppress the occurrence of the temperature droop.

Further, by the structure of the first nip portion N1 as stated above, an area where the fixing belt 614 comes in contact with only the fixing roll 610 is formed at the upstream side of the fixing belt 614 with respect to the inlet of the first nip portion N1. Thus, when the fixing belt 614 passes through this area, wrinkles of the fixing belt 614 produced during the rotation are removed. Accordingly, in the nip portion N, since the fixing belt can come in contact with the non-fixed toner image on the sheet P in a smooth state, an excellent fixed image can be obtained.

In the fixing device 60 of this embodiment, the toner image is fixed up to a level close to an ideal by pressure and heat acting in the first nip portion N1. At the most downstream portion of the first nip portion N1, the pressure roll 622 disposed to be urged to the center shaft of the fixing roll 610 applies pressure efficiently to the melted toner image by the local high pressure, so that the fixing property is secured, and the surface of the toner image is smoothed and an excellent image luster is given to the color image. As described above, since the pressure roll 622 is smaller than the fixing roll 610, and the surface is formed to be harder than the surface of the fixing roll 610, the local high pressure can be given to the toner image efficiently by a low load.

Figure 3:
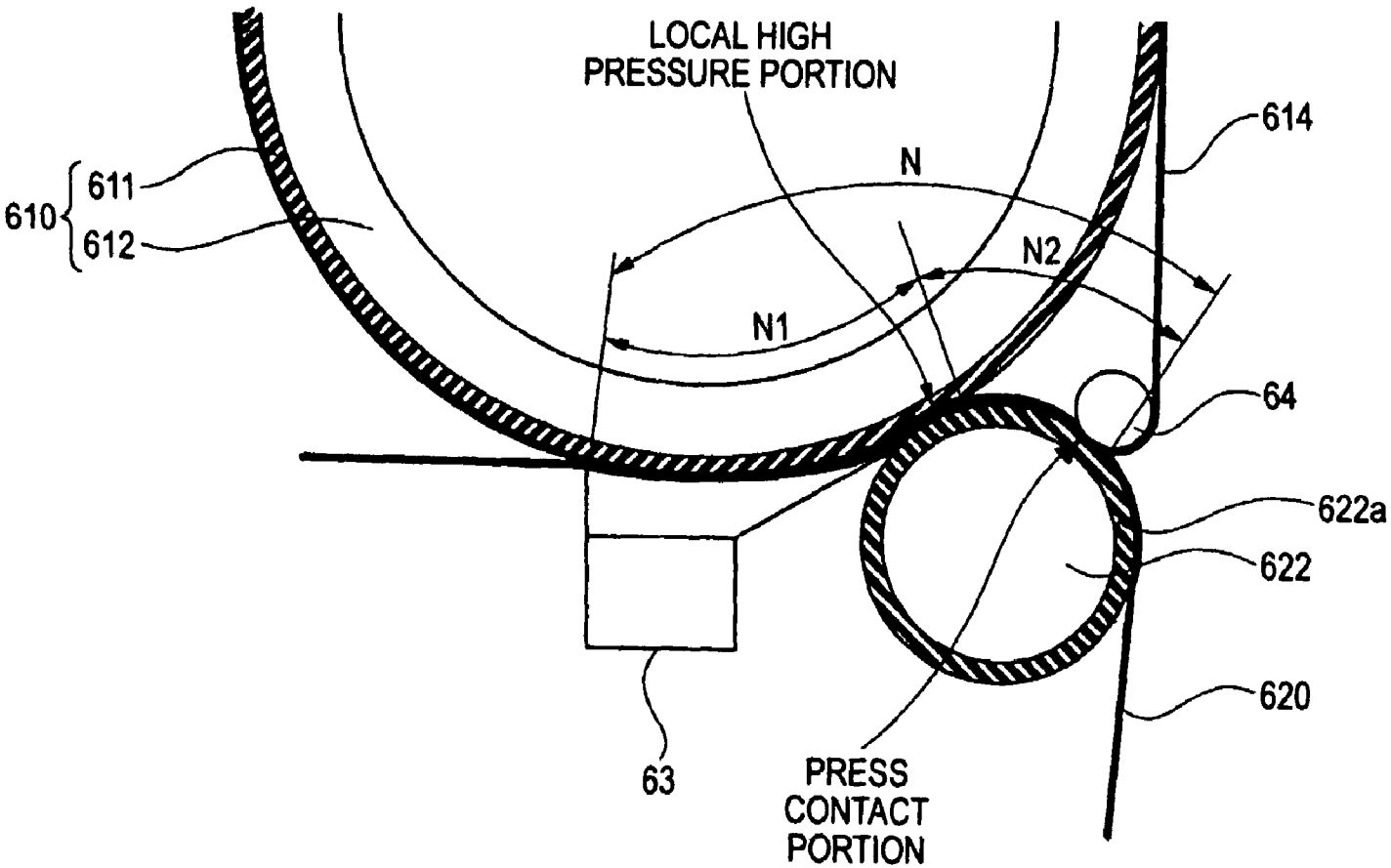
FIG. 3 is a view for explaining a structure of a nip portion.

After passing through the first nip portion N1, the sheet P is transported to the second nip portion N2. The second nip portion N2 is formed such that in the wrap area where the pressure belt 620 is wound around the pressure roll 622, and in a range from an area where the pressure roll 622 comes in press contact with the fixing roll 610 to an area where the peeling roll 64 comes in press contact with the pressure roll 622, the fixing belt 614 comes in press contact with the wrap area of the pressure roll 622. Accordingly, as shown in FIG. 3 in detail, while the first nip portion N1 has a curved shape being convex downward by the curvature of the fixing roll 610, the second nip portion N2 has a curved shape being convex upward by the curvature of the pressure roll 622.

Thus, the advancing direction of the sheet P heated and pressed under the curvature of the fixing roll 610 in the first nip portion N1 is changed according to the curvature of the pressure roll 622 directed in the opposite direction in the second nip portion N2. At that time, a minute micro-slip occurs between the toner image on the sheet P and the surface of the fixing belt 614. By that, the adhesion force between the toner image and the fixing belt 614 is weakened, and the sheet P is peeled off from the fixing belt 614. As stated above, the second nip portion N2 is placed as a preparation step for allowing peeling to be certainly performed at a final peeling step.

At the outlet of the second nip portion N2, since the fixing belt 614 is transported to be wound around the peeling roll 64 having a small diameter, the transport direction is abruptly changed there. That is, the peeling roll 64 is disposed to have a curved shape being convex downward with respect to the fixing belt 614, which is opposite to the pressure roll 622, and has a small curvature since its diameter is small, and therefore, the bending of the fixing belt 614 becomes large. Thus, the sheet P whose adhesion force to the fixing belt 614 is preliminary weakened in the second nip portion N2 can be certainly self-stripped from the fixing belt 614 by paper toughness owned by the sheet P itself.

Especially, since the second nip portion N2 has the curved shape being convex upward by the curvature of the pressure roll 622, a down curl can be formed on the sheet P, and therefore, the self strip from the fixing belt 614 can be accelerated.

In addition, the peeling roll 64 is disposed to come in press contact with the pressure roll 622 at a load of 5 kgf through the fixing belt 614 and the pressure belt 620. At that time, the peeling roll 64 is a hard roll made of stainless, and the pressure roll 622 is a soft roll coated with the elastic layer 622*a* at the outer surface. Thus, at a portion where the peeling roll 64 is in press contact with the pressure roll 622, a recess is formed on the surface of the pressure roll 622. By this recess, the sheet P is restrained from being wound around the pressure belt 620. That is, for example, at the time of two-sided printing, the toner image is born also on the back surface (pressure belt 620 side) of the sheet P, and when passing through the first nip portion N1, the toner image on the back surface is softened and is apt to adhere to the pressure belt 620. Then, when the recess is formed on the surface of the pressure roll 622 at the most rear end part of the second nip portion N2, a force is applied to the sheet P so that a small up curl is formed, and therefore, the sheet P does not move in accordance with the curvature of the pressure roll 622 but is peeled off also from the pressure belt 620. Accordingly, it becomes possible to perform peeling from not only the fixing belt 614 but also the pressure belt 620 at the time of two-sided printing.

When the peeling roll 64 is brought into press contact with the pressure roll 622, the elastic layer formed in the pressure belt 620 is also distorted and a recess is formed also in the pressure belt 620, and therefore, an effect of peeling off the sheet P from the pressure belt 620 is accelerated.

FIG. 4 shows results of an experiment in which self striping performances of back surface images at the time of two-sided printing are compared using the pressure rolls 622 having different thickness of the elastic layers 622*a* formed on the outer surfaces. In this experiment, silicone rubber with a rubber hardness of 30 Hs (JIS-A) was used for the elastic layer 622*a*. As sheets to be evaluated, OK top coat papers made by Oji Paper (Co., Ltd,) and having basis weight of 60, 81, 104, and 127 gsm were used. Further, toner images were born on both surfaces of the sheet P made to pass through the nip portion N, and the experiment was performed in the two-sided printing state. As a result, as shown in FIG. 4, it is confirmed that when the thickness of the elastic layer is formed to be 0.8 mm or more, even in the thin paper having a basis weight of 60 gsm being weak toughness, the sufficient self striping performance has been exhibited.

Here, it is desirable that the peeling roll 64 is formed to be smaller in diameter than the pressure roll 622 so that the peeling roll 64 applies the local high pressure to form the recess on the surface of the pressure roll 622. From the viewpoint that the peeling roll 64 abruptly changes the transport direction of the fixing belt 614, it is preferable that the peeling roll 64 is as small as possible in diameter. However, since the peeling roll has another function to stretch the fixing belt 614, a specified strength is necessary. Thus, it is suitable that the outer diameter of the peeling roll 64 is 5 to 20 mm, more preferably 6 to 13 mm.

As stated above, as a relation among the outer diameters of the fixing roll 610, the pressure roll 622, and the peeling roll 64, it is desirable to satisfy the relation of the fixing roll 610>the pressure roll 622>the peeling roll 64. Besides, as a relation among the hardness of the fixing roll 610, the pressure roll 622 and the peeling roll 64, it is desirable to satisfy the relation of the peeling roll 64>the pressure roll 622>the fixing roll 610.

As stated above, according to the fixing device 60 of this embodiment, in the range from the inlet of the nip portion N (the first nip portion N1 and the second nip portion N2) to the outlet thereof, the sheet P is put in the state where they are held between the two belts of the fixing belt 614 and the pressure belt 620, and the sheet is moved at the upstream side while being pressed to the fixing roll 610 side, is moved at the downstream side while being pressed to the pressure roll 622 side, and finally reaches the outlet of the nip portion N. Thus, in the inside of the nip portion N, since the sheet P is pressed to at least one of the rolls through one of the belts, it becomes possible to suppress water vapor generated from the sheet P and air expanded by receiving the heat in the area of the nip portion N, and it is possible to restrain the sheet P from rising in the inside of the nip portion N. As a result, it is also possible to suppress the occurrence of image defects.

Further, since both the fixing belt 614 and the pressure belt 620 for holding the sheet P are little expanded in the advancing direction, the occurrence of extension is suppressed also in the sheet P, and it becomes also possible to suppress the distortion and tilting of an image and to keep the uniformity of an image magnification.

The sheet P peeled off from the fixing belt 614 (and the pressure belt 620) in the second nip portion N2 is separated by a peeling guide plate 626 disposed at the downstream side of the nip portion N and in the vicinity of the surface of the fixing belt 614. The separated sheet P is guided by an exhaust guide 628, is transported to a paper output mount part (not shown) provided at an exhaust part of the image forming apparatus, and is mounted by an exhaust roll 629.

In the fixing device 60 of this embodiment, although a pressure pad is not disposed in the second nip portion N2, similarly to the pressure pad 63 in the first nip portion N1, it is also possible to adopt a structure in which a pressure pad is disposed also in the second nip portion N2. In that case, also in the second nip portion N2, a uniform nip pressure can be given.

As described above, in the fixing device 60 of this embodiment, the stretching roll 615 inside which the halogen heater 616 as the heating member is provided is disposed in parallel to the fixing roll 610, and the endless fixing belt 614 is stretched by the stretching roll 615 and the fixing roll 610. The fixing belt 614 is made to function as the main heating member for heating the sheet P, and both the fixing roll 610 and the stretching roll 615 are made to function as the heat supply member for supplying heat to the fixing belt 614. Thus, even if the speed of the fixing device 60 is increased, a specified fixing temperature can be always kept in the nip portion N, and accordingly, the occurrence of temperature droop can be suppressed.

After the toner image is fixed up to the level close to the ideal by applying pressure and heat in the first nip portion N1, the second nip portion N2 is constructed such that the peeling roll 64 as one of the rolls for stretching the fixing belt 614 is disposed to come in press contact with the pressure roll 622, and the fixing belt 614 comes in press contact with the wrap area of the pressure roll 622. By adopting the structure as stated above, it becomes possible to certainly self-strip the sheet P from the fixing belt 614.

[Embodiment 2]

In embodiment 1, the description has been given to the image forming apparatus including the fixing device 60 having the structure that the stretching roll 615 inside which the halogen heater 616 as the heating member is provided is disposed in parallel to the fixing roll 610, and the endless fixing belt 614 is stretched over the stretching roll 615 and the fixing roll 610. In embodiment 2, a description will be given to a fixing device 70 which is a fixing device mounted in the image forming apparatus shown in FIG. 1 and in which two stretching rolls 615 are disposed, and the one stretching roll newly disposed comes in contact with an outer surface of a fixing belt 614. Incidentally, a similar structure to embodiment 1 is denoted by the same reference numeral and the detailed description will be omitted here.

Figure 5:
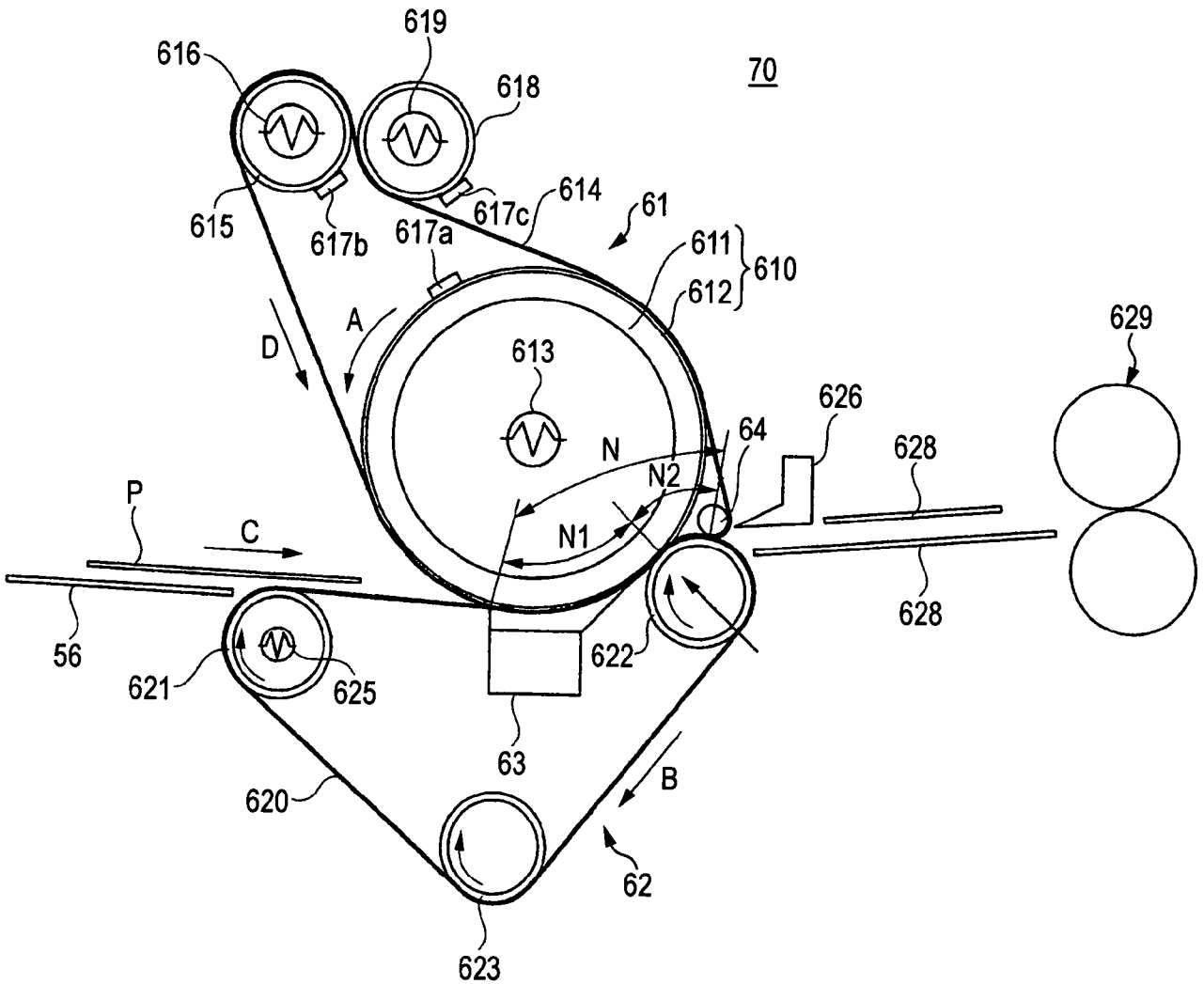
FIG. 5 is a side sectional view showing a structure of a fixing device of embodiment 2.
Figure 6:
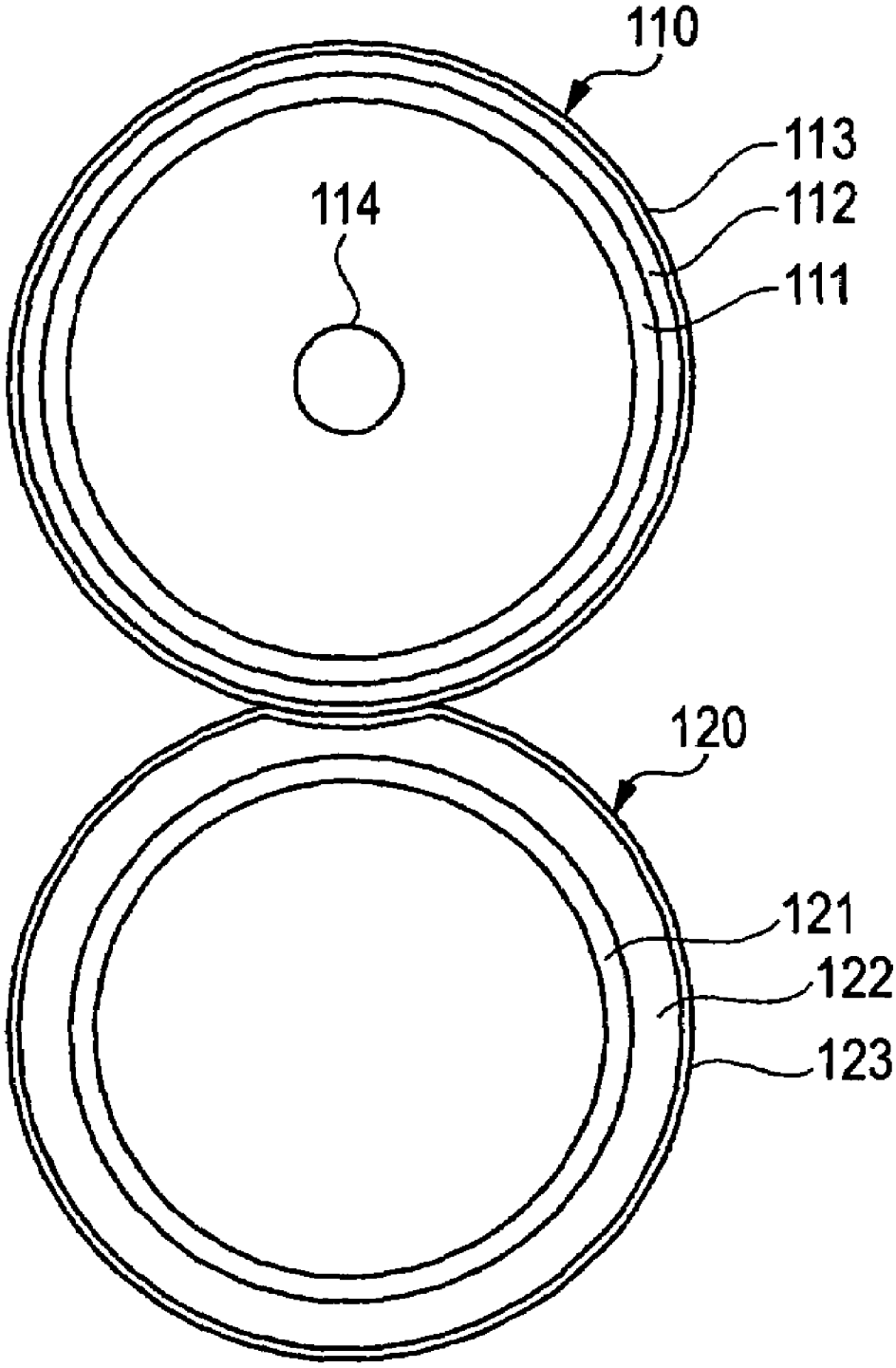
FIG. 6 is a side sectional view showing a structure of a conventional fixing device.

FIG. 5 is a side sectional view showing the structure of the fixing device 70 of this embodiment. The fixing device 70 of this embodiment is similar to the fixing device 60 of embodiment 1 except that in a fixing belt module 61, a stretching roll 618 is disposed in addition to a stretching roll 615.

In the fixing device 70 of this embodiment, the fixing belt module 61 is constructed of a fixing roll 610 rotating in the direction of an arrow A, the stretching roll 615 inside which a halogen heater 616 as a heating member is provided, the stretching roll 618 inside which a halogen heater 619 as a heating member is similarly provided, a peeling roll 64 disposed at the most downstream portion of a nip portion N, and a fixing belt 614 stretched over the fixing roll 610, the stretching roll 615, the stretching roll 618 and the peeling roll 64 and driven and rotated in the direction of an arrow D.

The fixing belt 614 is stretched by a tensile force of 10 kgf over the fixing roll 610, the stretching roll 615 and the stretching roll 618. In more detail, while the fixing belt 614 in embodiment 1 is stretched over the fixing roll 610 and the stretching roll 615, in the fixing device 70 of this embodiment, the stretching roll 618 is further disposed to be urged to the outer peripheral surface of the fixing belt 614, and a specified wound area (in this embodiment, a wrap angle is 80°, and a winding width is 16 mm) is formed. Accordingly, the fixing roll 610 and the stretching roll 615 come in contact with the inner peripheral surface of the fixing belt 614, and the stretching roll 618 comes in contact with the outer peripheral surface thereof and stretches the fixing belt 614. In this embodiment, the wrap angle of the fixing belt 614 with respect to the stretching roll 615 is also larger than that of embodiment 1 by the urging of the stretching roll 618 (in this embodiment, specifically, the wrap angle is 230°, and the winding width is 46 mm).

The stretching roll 618 has a stainless pipe roll with an outer diameter of 23 mm, a thickness of 2 mm, and a length of 350 mm as a base body, and PFA with a thickness of 20 μm is coated thereon to form a release layer. The release layer is formed to prevent a slight offset toner and paper powder from the outer peripheral surface of the fixing belt 614 from depositing on the stretching roll 618. The stretching roll 618 is formed into the so-called crown shape in which the outer diameter at the center part is larger than that at the end part by 100 μm in order to make a variation of the fixing belt 614 in the axial direction as small as possible and to uniform the stretching of the fixing belt 614. Incidentally, in addition to the case where both the stretching roll 615 and the stretching roll 618 are formed into the crown shape, either one of the stretching roll 615 and the stretching roll 618 may be formed into the crown shape.

The halogen heater 619 with a rated power of 800 W as a heating member is provided inside the stretching roll 618, and the surface temperature is controlled to be 200° C. by a temperature sensor 617*c* and the control part 40 (see FIG. 1). Accordingly, the stretching roll 618 has not only the function of stretching the fixing belt 614 but also the function of heating the fixing belt 614. Accordingly, since the halogen heater 616 as the heating member is provided inside the stretching roll 615 as well, in this embodiment, the fixing belt 614 is supplementarily heated by both the stretching roll 615 and the stretching roll 618.

Incidentally, the stretching roll 618 has also the function as a press roll for applying a load so that the tensile force of the whole of the fixing belt 614 becomes 10 kgf.

In the fixing device 70 of this embodiment, the stretching roll 615 in contact with the inner peripheral surface heats the fixing belt 614 from the inner peripheral surface side of the fixing belt 614, and the stretching roll 618 in contact with the outer peripheral surface heats the fixing belt 614 from the outer peripheral surface side. Thus, according to this embodiment, since the fixing belt 614 is heated from both the outer peripheral surface and the inner peripheral surface, it becomes possible to stably supply a larger amount of heat.

As stated above, the fixing device 70 of this embodiment also adopts the structure that the two rolls, that is, the stretching roll 615 inside which the halogen heater 616 as the heating member is provided, and the stretching roll 618 inside which the halogen heater 619 is provided are disposed in parallel to the fixing roll 610, and the stretching roll 615, the stretching roll 618 and the fixing roll 610 stretch the endless fixing belt 614. The fixing belt 614 is made to function as the main heating member for heating the sheet P, and the fixing roll 610, the stretching roll 615 and the stretching roll 618 are made to function as the heat supply member for supplying heat to the fixing belt 614. By that, the fixing belt 614 can be constructed to have a very small heat capacity, and can come in contact with the fixing roll 610, the stretching roll 615 and the stretching roll 618 with the wide wrap area. Thus, even if the speed of the fixing device 70 is increased, a specified fixing temperature can be always held in the nip portion N, and therefore, the occurrence of temperature droop can be suppressed.

Further, in the contact portion (nip portion N) between the pressure belt module 62 and the fixing belt module 61, a first nip portion N1 is constructed in which the pressure belt 620 is formed to come in press contact with the outer peripheral surface of the fixing belt 614 in a wrap area where the fixing belt 614 is wound around the fixing roll 610. In this first nip portion N1, a pressure pad 63 is disposed at the inside of the pressure belt 620 in such a state that the pressure pad is urged to the fixing roll 610 side through the pressure belt 620, and presses the pressure belt 620 to the wrap area of the fixing roll 610. At the most downstream portion of the first nip portion N1, a pressure roll 622 is urged to the center axis of the fixing roll 610 through the pressure belt 620 and the fixing belt 614 by a compression coil spring (not shown) as a pressure unit, and generates a local high pressure at the contact part of the fixing roll 610 and the fixing belt 614.

Besides, at the downstream side of the first nip portion N1, in a wrap area in which the pressure belt 620 is wound around the pressure roll 622, and in a range from an area where the pressure roll 622 comes in press contact with the fixing roll 610 to an area where the peeling roll 64 comes in press contact with the pressure roll 622, a second nip portion N2 is constructed which is continuous with the first nip portion N1 and in which the fixing belt 614 comes in press contact with the wrap area of the pressure roll 622.

Also in the fixing device 70 of this embodiment, by the structure as stated above, after the toner image is fixed up to the level close to the ideal by applying pressure and heat in the first nip portion N1, it becomes possible to certainly self-strip the sheet P from the fixing belt 614 in the second nip portion N2.

As utilization examples of this invention, there are an application to an image forming apparatus, such as a printer or a copying machine, using an electrophotographic system, and an application to, for example, a fixing device for fixing a non-fixed toner image born on a recording sheet (sheet). Besides, there are an application to an image forming apparatus, such as a copying machine or a printer, using an ink jet system, and an application to, for example, a fixing device for drying a non-dried ink image born on a recording sheet (sheet).

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A fixing device comprising:

a first belt module that includes a fixing belt, a first stretching roll, a fixing roll, a heater provided in the fixing roll, and a peeling roll, the fixing belt wound around the first stretching roll and the fixing roll; and a second belt module that includes a pressure belt wound around a second stretching roll and a pressure roll disposed to press the fixing roll, wherein the fixing belt of the first belt module and the pressure belt of the second belt module come in contact with each other in a first nip portion and a second nip portion, and the peeling roll presses the fixing belt to a side of the pressure roll.

2. The fixing device according to claim 1, wherein the first nip portion and the second nip portion are continuous with each other.

3. The fixing device according to claim 1, wherein the second belt module includes a press member that presses the pressure belt to a side of the fixing roll in the first nip portion.

4. The fixing device according to claim 1, wherein the first belt module includes a press member that presses the fixing belt to a side of the pressure roll in the second nip portion.

5. The fixing device according to claim 1, wherein a convex direction of the first nip portion and a convex direction of the second nip portion are opposite to each other.

6. The fixing device according to claim 1, wherein the peeling roll forms a recess on a surface of the pressure roll.

7. A fixing device for fixing a toner image born on a recording member, comprising:

a rotatable fixing roll;

a fixing belt stretched over the fixing roll;

a stretching roll that stretches the fixing belt; a pressure roll disposed to be pressed to the fixing roll;

a pressure belt stretched over the pressure roll and forming a nip portion with the fixing belt; and a peeling roll disposed to bring an outer surface of the fixing belt into contact with the pressure roll.

8. The fixing device according to claim 7, wherein the peeling roll is disposed to come in contact with the pressure roll through the fixing belt and the pressure belt.

9. The fixing device according to claim 7, wherein the peeling roll is disposed at a most downstream portion of the nip portion.

10. The fixing device according to claim 7, wherein the pressure roll has an elastic layer thereon.

11. The fixing device according to claim 7, wherein the pressure belt includes an elastic layer.

12. The fixing device according to claim 7, wherein the fixing roll, the pressure roll and the peeling roll satisfy the following formula in outer diameters: the fixing roll>the pressure roll>the peeling roll.

13. The fixing device according to claim 7, wherein the fixing roll, the pressure roll and the peeling roll satisfy the following formula in surface hardness: the peeling roll>the pressure roll>the fixing roll.

14. The fixing device according to claim 7, wherein the fixing roll includes a heating member inside, and the stretching roll includes a heating member inside.

15. The fixing device according to claim 7, wherein the stretching roll includes a plurality of stretching rolls.

16. The fixing device according to claim 15, wherein at least one of the stretching rolls is disposed to come in contact with an outer surface of the fixing belt.

17. An image forming apparatus comprising:

a toner image formation unit that forms a toner image;

a transfer unit that transfers the toner image formed by the toner image formation unit onto a recording member; and a fixing unit according to claim 8.

18. The image forming apparatus according to claim 17, wherein the fixing unit fixes the toner image onto the recording member in the first nip portion, and reduces an adhesion force between the recording member and the fixing belt in the second nip portion.

19. The image forming apparatus according to claim 17, wherein the fixing roll includes a heating member inside, and the stretching roll includes a heating member inside.

20. The image forming apparatus according to claim 17, wherein a first nip portion is formed on the fixing roll around which the fixing belt is wound, and a second nip portion is continuous with the first nip portion and formed on the pressure roll around which the pressure belt is wound.

* * * * *